US007252493B1

(12) United States Patent
Johnston et al.

(10) Patent No.: US 7,252,493 B1
(45) Date of Patent: Aug. 7, 2007

(54) TEMPERATURE CONTROL SYSTEM TO INDEPENDENTLY MAINTAIN SEPARATE MOLTEN POLYMER STREAMS AT SELECTED TEMPERATURES DURING FIBER EXTRUSION

(75) Inventors: Brian Johnston, Melbourne, FL (US); Jeff Haggard, Cocoa, FL (US); Arnold Wilkie, Merritt Island, FL (US); Ruey Chern, Melbourne, FL (US); Mark Miller, West Melbourne, FL (US); Tony Owen, Indialantic, FL (US); John Quinlivan, Indialantic, FL (US); Ted Mire, Satellite Beach, FL (US); Brent Soucier, Palm Bay, FL (US); Kevin Moschetti, Palm Bay, FL (US)

(73) Assignee: Hills, Inc., West Melbourne, FL (US)

( * ) Notice: Subject to any disclaimer, the term of this patent is extended or adjusted under 35 U.S.C. 154(b) by 291 days.

(21) Appl. No.: 10/676,271

(22) Filed: Oct. 2, 2003

Related U.S. Application Data

(60) Provisional application No. 60/415,093, filed on Oct. 2, 2002.

(51) Int. Cl.
*D01D 1/06* (2006.01)
*D01D 4/02* (2006.01)

(52) U.S. Cl. ..... 425/144; 425/143; 425/378.2; 425/534; 264/209.7

(58) Field of Classification Search ..... 425/143, 425/144, 378.2; 264/209.7
See application file for complete search history.

(56) References Cited

U.S. PATENT DOCUMENTS 2,974,361 A * 3/1961 Gercke et al. ..... 425/229
3,557,407 A * 1/1971 Lemelson ..... 425/71
3,594,863 A * 7/1971 Erb ..... 425/505
3,659,989 A * 5/1972 Uraya et al. ..... 425/131.5
3,782,875 A * 1/1974 Olschewski ..... 425/223
3,864,068 A * 2/1975 Flakne ..... 425/192 R
4,437,827 A * 3/1984 Moderlak et al. ..... 425/378.2
5,009,687 A * 4/1991 Kromrey ..... 65/106
5,149,481 A * 9/1992 Gross et al. ..... 264/210.2
5,162,074 A 11/1992 Hills
5,268,132 A * 12/1993 Keilert et al. ..... 264/169
5,705,203 A * 1/1998 Andersen et al. ..... 425/407
6,083,432 A * 7/2000 Schafer ..... 264/39
6,164,950 A * 12/2000 Barbier et al. ..... 425/378.2
6,306,327 B1 * 10/2001 Fujii et al. ..... 264/210.2
6,409,491 B1 * 6/2002 Leffew et al. ..... 425/67
6,495,214 B1 * 12/2002 Prix et al. ..... 427/510

* cited by examiner

*Primary Examiner*—Robert Davis
*Assistant Examiner*—Dimple Bodawala
(74) *Attorney, Agent, or Firm*—Edell, Shapiro & Finnan, LLC

(57) ABSTRACT

A temperature control system for use in a fiber extrusion process includes a number of metering pump assemblies including inlets to receive at least two molten polymer streams from a supply source that is connectable to the system. A pump block disposed proximate the metering pump assemblies includes a plurality of flow paths extending within the pump block, where the flow paths are aligned to receive molten polymer flowing from outlets of the metering pump assemblies and to deliver the molten polymer to a spinneret. The flow paths are arranged in flow path sets within the pump block, and each flow path set includes at least one flow path and is spaced a selected distance from the other flow path sets within the pump block so as to facilitate independent control of the temperature of a molten polymer flowing through each flow path set.

21 Claims, 6 Drawing Sheets

TEMPERATURE CONTROL SYSTEM TO INDEPENDENTLY MAINTAIN SEPARATE MOLTEN POLYMER STREAMS AT SELECTED TEMPERATURES DURING FIBER EXTRUSION

CROSS REFERENCE TO RELATED APPLICATIONS

This application claims priority from U.S. Provisional Patent Application Ser. No. 60/415,093, entitled "Pump Block For Multi-Component Spin Beam To Maintain Separate Polymer Temperatures", filed Oct. 2, 2002. The disclosure of this provisional patent application is incorporated herein by reference in its entirety.

BACKGROUND OF THE INVENTION

1. Field of the Invention

The present invention relates to equipment and corresponding methods for producing extruded fibers. In particular, the present invention relates to heat control equipment and corresponding methods to control the temperature of molten polymer being extruded to form synthetic fibers.

2. Description of the Related Art

Plural component fiber extrusion processes (e.g., conjugate filament, conjugate staple, conjugate spunbond, and conjugate monofilament) typically employ two or more polymers in combinations and fiber cross-section structure in the production of plural component fibers (e.g., bicomponent, tricomponent, etc.) with selected characteristics. The term "spunbond" refers to a process of forming a non-woven fabric or web from an array of thin, melt-spun polymeric fibers or filaments produced by extruding molten polymer from orifices (the orifices can be, for example, those of a long, generally rectangular spinneret or of a plurality of spinnerets). In a typical spunbond process, one or more molten polymer streams are metered to a heated spin beam that supports a pump block for controlling the flow of molten polymer and a spin pack. The term "spin pack" refers to an assembly for processing and routing the molten polymer to produce extruded polymer streams, including final polymer filtration, distribution systems and a spinneret for extruding molten polymer combinations into plural component fibers.

For certain polymer combinations and/or cross-sections of the fibers to be formed, it is very important to maintain precise temperature control of two or more different polymers so as to control viscosity and/or prevent thermal degradation of the molten polymers as they flow through the spin beam. An exemplary polymer combination that must be precisely temperature controlled, for substantially any fiber cross-section to be formed, is the combination of ethylene-vinyl alcohol copolymer (EVOH) and polyethylene terephthalate (PET). The PET must be extruded above 285° C. while the EVOH will degrade if it is above 240° C. for more than one minute. Typically, the average time that each molecule of the molten polymer remains in a conventional spinning system is well in excess of one minute.

Another example involves the formation of segmented pie fiber cross-sections, where the viscosities of different molten polymers used to form the fiber must be substantially similar to achieve a sharp center point for the extruded fiber. Independent temperature control is often necessary to precisely adjust the viscosity of two or more different polymers to prevent thermal degradation of molten polymer in the spin beam as well as to achieve a desired fiber cross section.

Conventional spunbond and other fiber extrusion processes typically employ a vapor-heated spin beam with a single temperature zone, where the different polymers pass through pipes that are heated by this single zone. The polymers quickly reach the beam temperature due to the vapor heating the pipes. However, such a system does not allow for independent control of the polymer temperatures. As previously noted, this can negatively impact the formation of plural component fibers with different polymer components having different degradation temperatures and/or different viscosity characteristics.

Thus, it is desirable to provide a system that can effectively and independently control molten polymer streams at two or more distinct temperatures during a fiber extrusion process.

SUMMARY OF THE INVENTION

It is an object of the present invention to deliver two or more molten polymer streams to a fiber extrusion process at different temperatures.

Another object of the present invention is to independently and effectively control the temperatures of different molten polymer streams in a fiber extrusion process.

Yet another object of the present invention is to effectively and precisely control the temperatures of different molten polymer streams in a fiber extrusion process so as to prevent thermal degradation of the polymer streams.

A further object of the present invention is to effectively and precisely control the temperatures of different molten polymer streams in a fiber extrusion process so as to independently control the viscosity of each molten polymer stream.

The aforesaid objects are achieved individually and in combination, and it is not intended that the present invention be construed as requiring two or more of the objects to be combined unless expressly required by the claims attached hereto.

According to the present invention, a temperature control system for use in a fiber extrusion process (e.g., a spunbond process) includes a number of metering pump assemblies including inlets to receive at least two molten polymer streams from a supply source that is connectable to the system. A pump block disposed proximate the metering pump assemblies includes a plurality of flow paths extending within the pump block, where the flow paths are aligned to receive molten polymer flowing from outlets of the metering pump assemblies and to deliver the molten polymer to a spinneret. The flow paths are arranged in flow path sets within the pump block, and each flow path set includes at least one flow path and is spaced a selected distance from the other flow path sets within the pump block so as to facilitate independent control of the temperature of a molten polymer flowing through each flow path set Thus, the temperature control system of the present invention permits independent temperature control for two or more molten polymer streams entering the pump block, with the temperatures of the molten polymer streams being further maintained at their respective temperatures prior to and during formation of the extruded fibers. In particular, the molten polymer streams can be substantially maintained at their respective inlet temperatures to the pump block. In scenarios in which two molten polymer streams contain different polymers at significantly different temperatures, the system of the present invention minimizes the temperature rise of the low temperature polymer stream to within about 0-50% of the difference between the incoming temperature of the low temperature polymer stream and the spin beam temperature and/or a maximum temperature for a high temperature polymer stream processed by the system. The amount of temperature differential that can be attained is dependent upon the physical layout necessitated by various design constraints, the flow rates for a given process being run at any given time, the temperatures employed for a given process, and the thermodynamic characteristics of the low temperature polymeric material. For example, in a temperature control system including a spin beam maintained at a temperature of 290° C. and a molten polymer stream with an inlet temperature to the system of 220° C., the exit temperature from the system of the molten polymer stream would be approximately 220° C.-255° C., with variance in exit temperature being based upon flow rate and residence time of the polymer stream within the system.

The above and still further objects, features and advantages of the present invention will become apparent upon consideration of the following detailed description of a specific embodiment thereof, particularly when taken in conjunction with the accompanying drawings wherein like reference numerals in the various figures are utilized to designate like components.

DESCRIPTION OF THE PREFERRED EMBODIMENTS

In accordance with the present invention, a temperature control system for a fiber extrusion system is provided for processing two or more molten polymer streams so as to substantially and independently maintain each molten polymer stream at a selected temperature prior to and during formation of extruded polymer fibers. The temperature control system may be utilized in any fiber extrusion process including, without limitation, spunbond and meltblown systems. In addition, the temperature control system may be utilized in combination with a fiber extrusion process to form any type of mono and/or plural component fibers with any selected cross-sectional geometries including, without limitation, side-by-side, sheath/core, islands-in-the-sea, segmented pie, ribbon-shaped, multi-lobed, etc.

Figure 1:
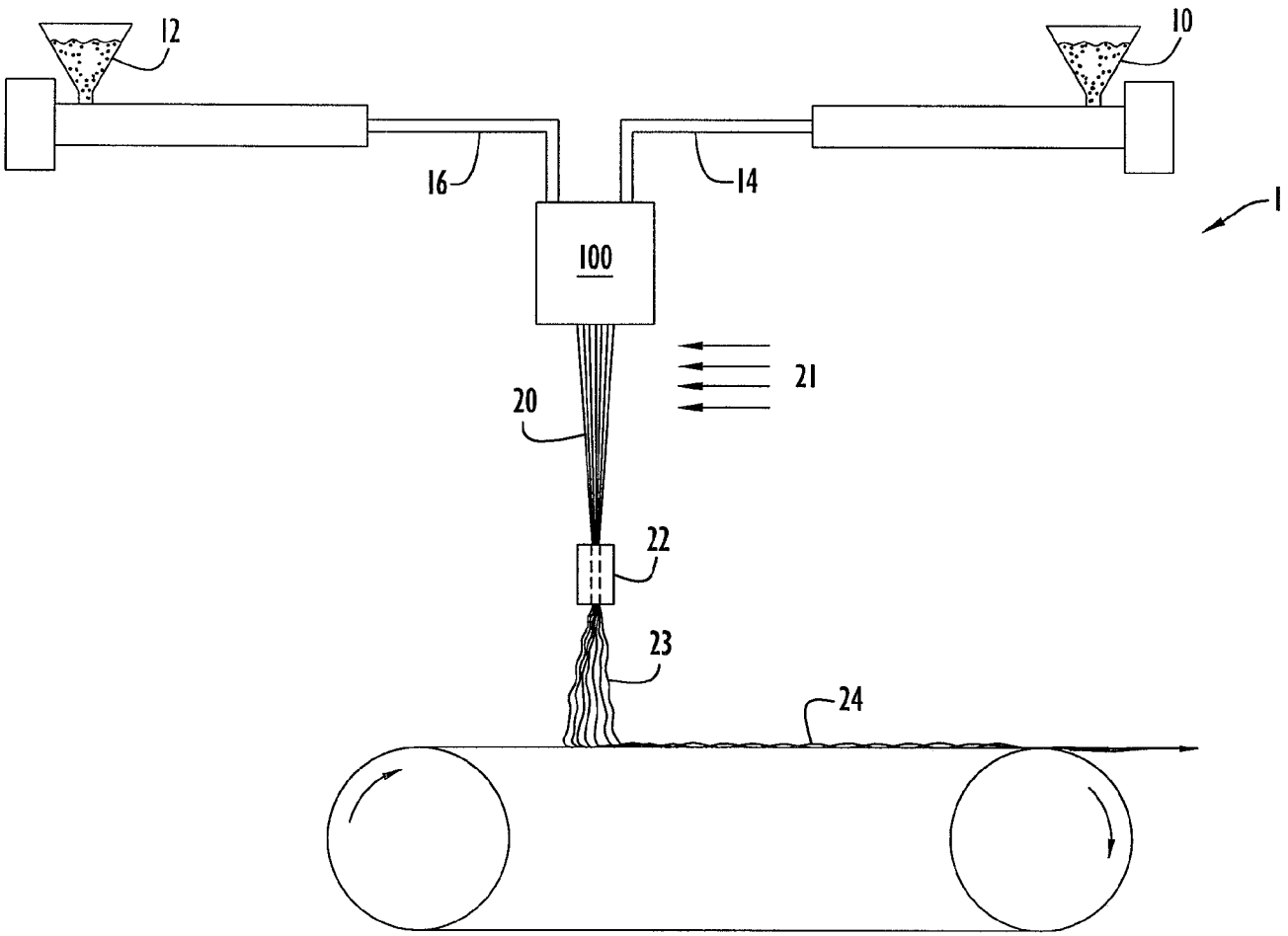
FIG. 1 is a diagrammatic view of a spunbond system for forming islands-in-the-sea fibers in accordance with the present invention.

An exemplary fiber extrusion process is illustrated in FIG. 1, in which the temperature control system of the present invention is combined with a spunbond system. Spunbond system 1 includes a pair of hoppers 10 and 12 into which pellets of two different polymer components are melted prior to delivery to temperature control system 100. While spunbond system 1 is configured for processing two molten polymer streams, it is noted that any selected number of different molten polymer streams can be processed by the spunbond and temperature control system of the present invention. The molten polymer streams flow through heated flow pipes 14 and 16 and into temperature control system 100. The molten polymer streams are processed in the temperature control system and extruded through a spinneret, as described below, so as to form extruded fibers 20 of selected cross-sectional geometric configurations. The extruded fibers are then quenched (e.g., with blown air 21) and attenuated in a drawing unit 22 (e.g., an aspirator). The attenuated fibers 23 are laid down on a support surface 24 (e.g., a continuous belt) and are collected and/or subjected to further conventional or other processing treatments (e.g., bonding, heat treatment, etc.).

The temperature control system of the present invention effectively and independently maintains different molten polymer streams at different selected temperatures by separating and/or partitioning sets of one or more flow paths (e.g., channels and/or conduits) within the system and insulating and/or including separate and independent temperature control systems to substantially maintain the flow paths at selected temperatures. Different molten polymer streams are directed to different flow path sets within the system to ensure independent polymer temperature control during system operation. A number of different heat control features may be provided for each set of flow paths to achieve independent temperature control of the molten polymer directed through each set of one or more flow paths. Exemplary embodiments of different temperature control systems in accordance with the present invention are described below.

Figure 2:
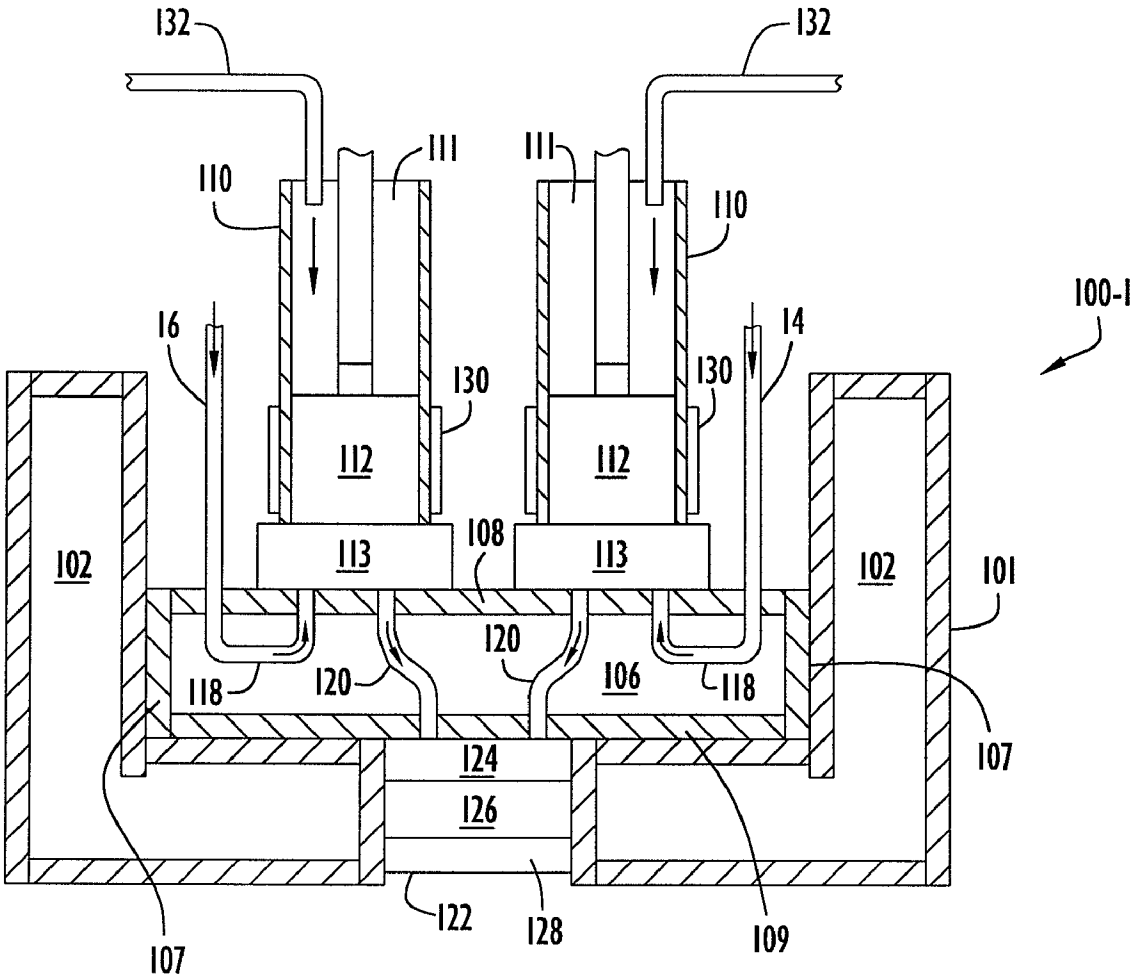
FIG. 2 is a side elevational view in section of one embodiment of a spin beam assembly for the system of FIG. 1.

In a first exemplary embodiment depicted in FIG. 2, a temperature control system 100-1 includes a spin beam 101 having a cross-section that defines two facing L-shaped sections 102, and a spin pack 122 disposed between a gap defined between the lower leg portions of the L-shaped sections. The L-shaped sections are hollow and are filled with a suitable circulating heating medium (e.g., Dowtherm) to maintain the spin beam at a selected temperature during system operation. Alternatively, the spin beam may be heated utilizing any other suitable heating mechanism (e.g., temperature controlled heaters or heating jackets). The heated spin beam in turn maintains spin pack 122 at a selected temperature during system operation. The spin beam and spin pack are constructed of metals with sufficient heat transfer coefficients to effectively transfer heat from the spin beam to the spin pack so as to heat the spin pack to a desired temperature.

Resting between L-shaped spin beam sections 102 and disposed directly above and adjacent spin pack 122 is a hollow pump block 106. The pump block includes a top plate 108 and a bottom plate 109 defining the upper and lower wall sections of the pump block, and opposing side walls 107 disposed between the top and bottom plates. Disposed directly above and adjacent top plate 108 is a set of metering pump assemblies 110. Each metering pump assembly 110 includes at least one metering pump 112 that is disposed within a hollow chamber 111 and is separated from the pump block by a base or wear plate 113. The metering pumps control the flow rate of molten polymer fluid through the temperature control system. While only two metering pump chambers and metering pumps are depicted in FIG. 2, it is noted that any suitable number of metering pump chambers and/or metering pumps may be provided depending upon the number of molten polymer streams to be processed by the system and the desired flow rates of the streams through the system.

Flow pipes 14 and 16 deliver the separate molten polymer streams to a respective metering pump. In the embodiment depicted in FIG. 2, each flow pipe 14, 16 extends to and communicates with a channel disposed and extending transversely through top plate 108. Disposed within temperature control chamber 106 are two U-shaped conduits 118, each aligned at one end and in communication with a top plate channel and respective flow pipe 14, 16. The other end of each U-shaped conduit 118 extends to and communicates with another respectively aligned channel extending through top plate 108 and wear plate 113 to an inlet to a respective pump 112, thus permitting molten polymer to flow from pipes 14 and 16 into their respective pumps 112. Alternatively, it is noted that the flow pipes may connected directly to the metering pumps, rather than extending into portions of the pump block.

Similarly, a series of outlet conduits extend within hollow pump block 106 between top and bottom plates 108 and 109 to communicate with respectively aligned channels in the wear plate and top and bottom plates to permit molten polymer to flow from outlets of a respective pump 112 to corresponding inlets of spin pack 122. While only two U-shaped conduits 118 and pump outlet conduits 120 are depicted in FIG. 2, any suitable number of inlet and/or outlet conduits may be provided within the pump block for each pump. Preferably, each pump includes two or more outlet conduits per inlet conduit. For example, each pump may include a single inlet conduit and 8 outlet conduits, where each outlet conduit meters polymer fluid at the same or a substantially similar flow rate to the spin pack.

The spin pack includes a series of stacked plates to receive and process flowing molten polymer streams delivered by the metering pumps for extrusion of polymer fibers. The spin pack may include any selected configuration of orifices and channels to combine two or more molten polymer streams in any number of selected combinations so as to produce any selected types of cross-sectional fiber geometries (e.g., any of the previously described fiber cross sections) containing one or more polymer components. An exemplary spin pack that may be utilized with the system of the present invention is described in U.S. Pat. No. 5,162,074, the disclosure of which is incorporated herein by reference in its entirety. Referring to FIG. 2, spin pack 122 includes a pack top plate 124 disposed adjacent bottom wall 109, a screen support plate 126 disposed directly below pack top plate 124 to screen or filter contaminates and/or other particulate material from the molten polymer, and a spinneret 128 disposed directly below screen support plate 126. The top plate and screen support plate each include suitable orifices and channels to facilitate transfer and/or combination of molten polymer streams from the metering pumps to the spinneret. The spinneret contains an array of spinning orifices, typically from 1000 to 5000 per meter of length of the spinneret, through which molten polymer flows to form the extruded fibers.

The hollow pump block 106 is filled with a suitable insulation material to minimize, or prevent heat transfer between separated sets of conduits containing different molten polymer streams. Any suitable conventional or other insulation material may be utilized including, without limitation, castable insulating material (e.g., spherical or other shaped glass beads of selected dimensions) that forms an insulating barrier around each of the conduits within block 106. The side plates 107 are preferably removable from the pump block 106 to permit easy installation and removal of insulation material from the pump block.

The top, bottom and side plates of the pump block as well as the conduits disposed within the pump block are preferably constructed of a material having a low thermal conductivity to maximize temperature independence of the molten polymer streams flowing into and out of the pump block. Examples of suitable materials of construction for the conduits and/or pump block plates are any of the 300 series stainless steels (e.g., 304 stainless steel, 316 stainless steel, etc.). In addition, the sets of conduits within the pump block carrying the same molten polymer flow streams (or streams containing different polymers that exhibit similar thermal behavior) to the spin pack are preferably bundled close together and separated a suitable distance from other sets of conduits containing different molten polymer streams.

The flow pipes and conduits may be connected in any suitable manner (e.g., via welding or brazing) to the top and bottom plates of the pump block to provide a fluid tight seal at the connection. An exemplary method for connecting any tubing (i.e., conduits and/or flow pipes) to the plates is as follows: (1) chamfer the orifice in the plate and position the tubing flush with the bottom of the chamfer; (2) fully weld the entire chamfer; and (3) machine a hole and/or seal the seat through the weld connecting to the opening in the tube. Further, all sets of flow conduits within the pump block that deliver the same molten polymer flow streams (or streams containing different polymers exhibiting similar thermal behavior) to the spin pack are preferably of the same or similar dimensions (i.e., length and transverse cross-sectional dimensions or diameter) so as to ensure the same or similar residence time for these flow streams through the pump block.

Operation of the spunbond system including the temperature control system of the present invention is described in relation to FIGS. 1 and 2. Two differing polymer materials A and B (i.e., molten polymer streams having different thermal properties and characteristics, such as viscosities, melting points, etc.) are directed into hoppers 10 and 12 and melted to form molten polymer streams that are directed to temperature control system 100-1 via pipes 14 and 16. The molten polymer streams are directed to separate metering pumps 112, via a respective conduit 118, and each metering pump independently delivers its respective molten polymer stream at a selected flow rate, via one or more conduits 120, to spin pack 122. The spin pack filters the molten polymer streams, via screen support plate 126, and delivers the streams to spinneret 128 for extrusion and formation of polymer fibers 20. As previously noted, the spin pack is configured to combine polymer streams A and B in any suitable manner to form any one or more selected cross-sectional fiber configurations. The extruded fibers are attenuated and further processed by spunbond system 1 as described above.

The temperature control system as described above ensures a suitable separation of differing molten polymer streams (e.g., streams A and B) during processing by the temperature control system. The system further minimizes or prevents the potential for heat transfer between the differing streams at least until the streams reach the spin pack while facilitating independent temperature maintenance of each molten polymer to within a selected temperature range via controlled heat input to the polymer streams as they flow through the system. In particular, for scenarios requiring two or more molten polymer streams containing polymers at significantly different temperatures, the system of the present invention minimizes the temperature rise of the low temperature polymer stream to within about 0-50% of the difference between the incoming temperature of the low temperature polymer stream and the spin beam temperature and/or a maximum temperature for a high temperature polymer stream processed by the system. Thus, the temperature control system of the present invention facilitates the production of plural component fibers with combinations of two or more polymers having significantly different extrusion temperatures (e.g., PET and EVOH) while independently controlling the temperature of each molten polymer stream and minimizing high temperature exposure of the lower melting polymer during the extrusion process.

The system may include additional features to enhance independent temperature control of the differing molten polymer streams. For example, the metering pumps may be independently heated or cooled to selected temperatures (or selected temperature ranges) to permit precise and independent temperature control of each pump. Referring again to FIG. 2, each metering pump assembly 110 may include a heating element 130 to heat the assembly and its respective metering pump 112 to a selected temperature. The heating element may include a controller coupled in any conventional manner to one or more temperature sensors disposed at any suitable locations in order to provide feedback of the metering pump temperature and/or the temperature of the molten polymer stream at locations upstream and/or downstream of the metering pump. In addition, or as an alternative, to the implementation of heating elements for the metering pumps, each metering pump assembly 110 may include a thermal supply conduit 132 to provide a thermal treatment fluid (e.g., air, Dowtherm, etc.) within metering pump chamber 111. The thermal treatment fluid may be used to heat and/or cool the metering pump by providing the thermal treatment fluid at a selected temperature and/or flow rate within chamber 111. For example, a constant volume of air may be blown into pump chamber 111 to selectively cool a metering pump 12, while a heater 130 selectively heats the metering pump.

Figure 3:
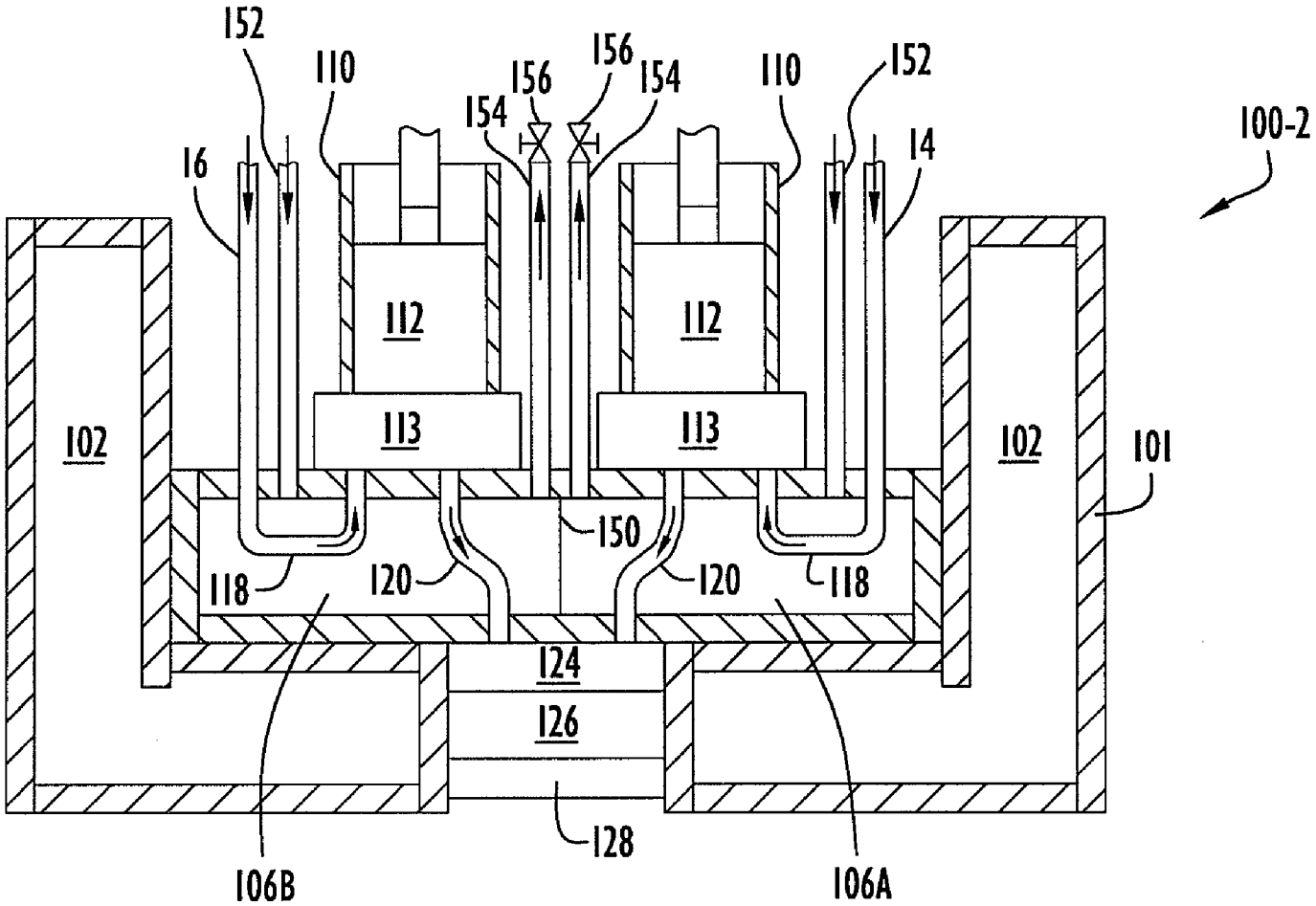
FIG. 3 is a side elevational view in section of another embodiment of the spin beam assembly for the system of FIG. 1.

In another embodiment depicted in FIG. 3, a temperature control system 100-2 is provided that is substantially similar to the temperature control system described above and depicted in FIG. 2, and further includes a thermally insulated baffle or partition 150 disposed within hollow pump block 106 and extending between top and bottom plates 108 and 109. The partition separates the hollow pump block into distinct compartments or chambers 106A and 106B that house the sets of conduits for the differing molten polymer flow streams. While one partition and two compartments are depicted in FIG. 3, it is noted that any selected number of partitions and compartments may be formed within the pump block, depending upon the number of differing molten polymer streams to be processed and corresponding sets of conduits that are provided within the pump block to receive the streams. The separate compartments can be provided with the same or different insulating materials to enhance temperature control within each compartment as well as minimize or prevent heat transfer between two or more compartments.

Gas supply conduits can optionally be provided to independently flow a thermal treatment fluid (e.g., a heating or cooling gas) through each partitioned compartment 106A and 106B to further control the temperature of molten polymer fluid streams flowing through the sets of conduits disposed within each compartment. In particular, each compartment 106A and 106B includes an inlet conduit 152 extending to and in communication with a corresponding channel extending through top plate 108 at a location remote from partition 150. Each compartment 106A and 106B further includes an outlet conduit 154 extending to and in communication with a corresponding channel extending through top plate 108 at a location proximate partition 150. Thus, system 100-2 permits a separate thermal treatment fluid to flow through each compartment, via inlet and outlet conduits 152 and 154, so as to independently thermally treat (i.e., heat and/or cool) the sets of polymer flow conduits within each compartment 106A, 106B in order to substantially maintain the differing polymer streams at their respective set point temperatures. The thermal treatment fluid in each compartment can be controlled independently so as to flow at a selected rate. For example, thermal treatment fluid may be flowed through a compartment at a selected temperature to achieve a selected temperature within the compartment, and then continuously flowing the thermal treatment fluid through the compartment at a fixed rate.

The fluid flow rate of the thermal treatment fluid through each compartment 106A, 106B can be independently controlled, e.g., via a pressure controller disposed at each inlet conduit 152. Alternatively, if a gas is utilized as the thermal treatment fluid, the flow rate of the gas may be independently controlled through the compartments by providing an adjustable damper or valve 156 at each outlet conduit 154 so as to control the flow of gas through each compartment via a "chimney effect".

The temperature control system described above may be further modified to enhance independent temperature control of differing molten polymer flow streams flowing through the system. In the embodiment depicted in FIG. 4, a temperature control system 100-3 is provided that is substantially similar to the temperature control system described above and depicted in FIG. 2, and further including thinned areas or grooved sections 160 disposed at selected locations on top plate 108 between pumps 112 to prevent or minimize thermal energy transfer between the pumps. Top plate 108 may also include grooved sections or recesses 160 at the location of any inlet and/or outlet pipes or conduits to prevent or minimize heat transfer between molten polymer fluid and the top plate.

Figure 4:
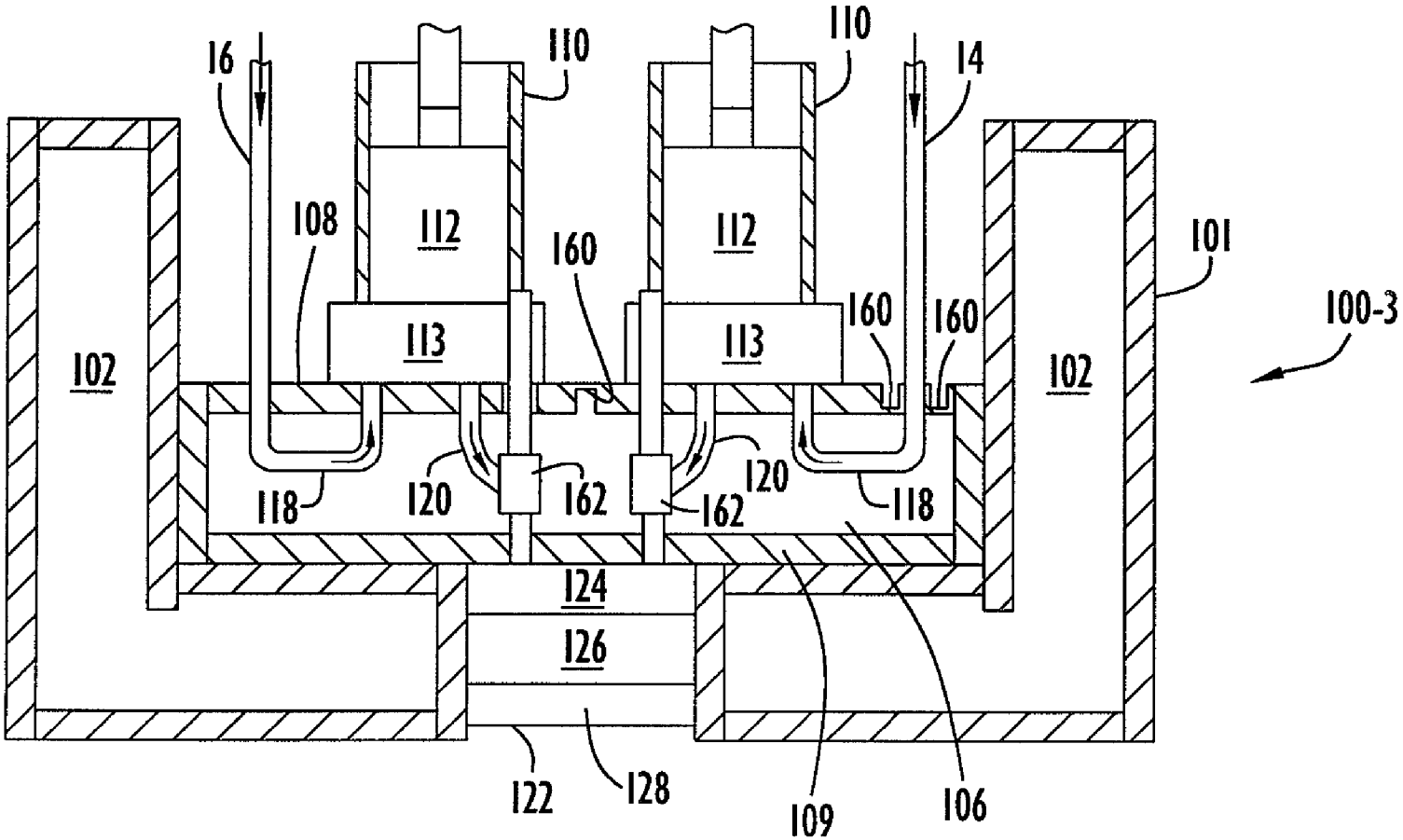
FIG. 4 is a side elevational view in section of a further embodiment of the spin beam assembly for the system of FIG. 1.

Further, temperature and/or pressure sensors 162 (e.g., (e.g., transducers, thermocouples, IR sensors, RTDs, etc.), as depicted in FIG. 4, can optionally be connected to the conduits and/or at any other sections (e.g., within the partitioned compartments depicted in FIG. 3) in the pump block to provide an indication of the temperature and/or pressure of polymer fluid flowing within the separated sets of conduits. The measurement devices are preferably disposed at locations within the pump block that are removed from the pump block plates so as to minimize or prevent exposure of heat transfer between the pump block plates and the measurement devices.

Figure 5:
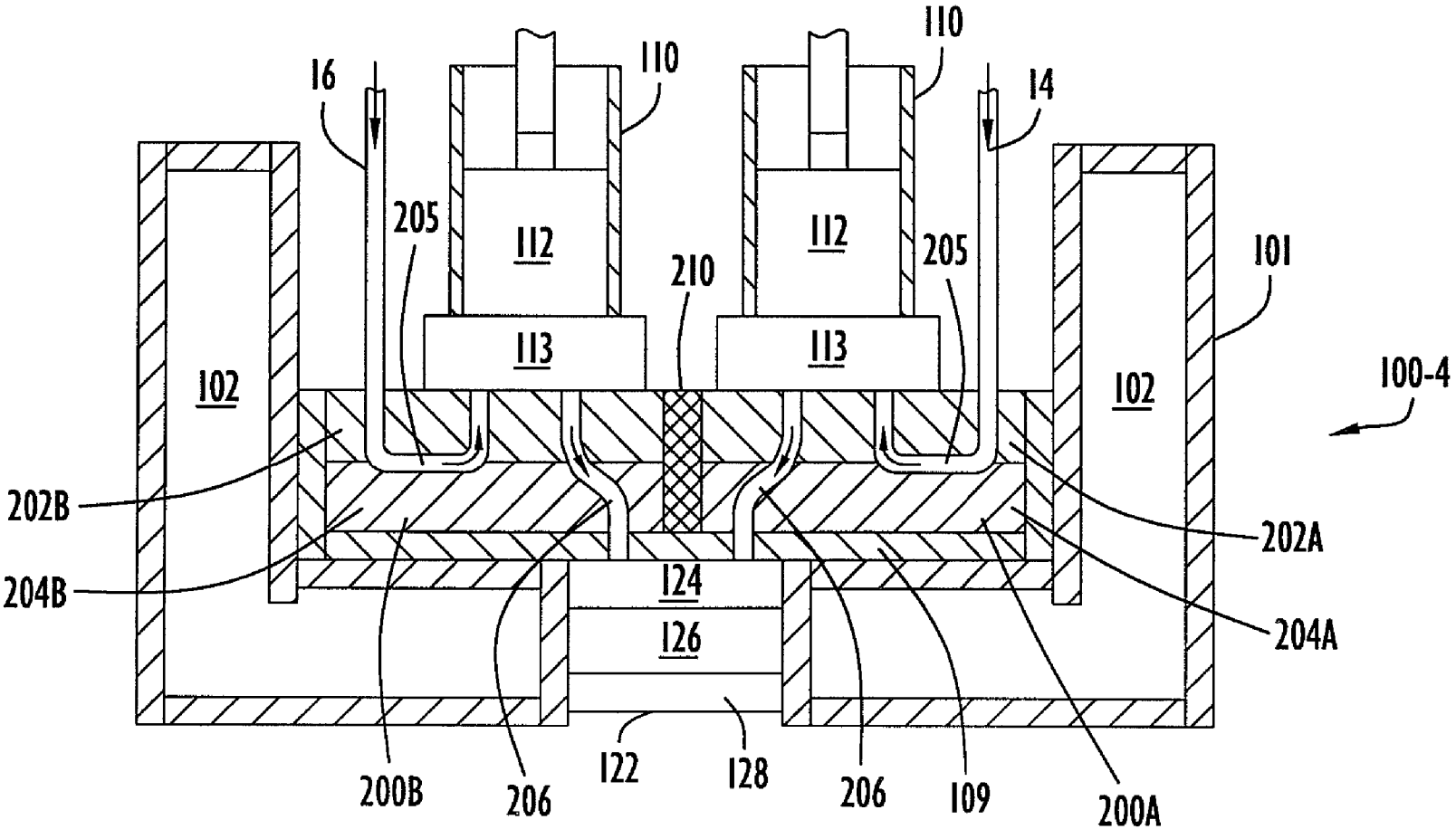
FIG. 5 is a side elevational view in section of a still further embodiment of the spin beam assembly for the system of FIG. 1.

Yet another embodiment of a temperature control system is depicted in FIG. 5. Specifically, temperature control system 100-4 is similar to the system described above and depicted in FIG. 1, with the exception that the pump block is not hollow but rather includes a series of stacked plates that are separated or partitioned by an insulating material. Specifically, the pump block is partitioned into two pump block sections 200A and 200B that rest on bottom plate 109 and are separated from each other by a thermal insulating section 210 that is disposed between metering pumps 112 and extends vertically from the upper surface of the pump block sections to the bottom plate. Alternatively, it is noted that the insulating section may not extend completely through the pump block, such that the pump block sections may be partially joined by one or more linking portions. Each pump block section 200A, 200B includes an upper plate 202A, 202B disposed adjacent a wear plate 113 for a respective metering pump 112 and a lower plate 204A, 204B disposed between its respective upper plate and bottom plate 109. Pipes 14 and 16 communicate with U-shaped channels 205 defined in complimentary portions of the upper and lower plates to facilitate delivery of molten polymer fluid from the pipes to their respective metering pumps. Similarly, channels 206 defined in complimentary portions of the upper, lower and bottom plates facilitate delivery of molten polymer fluid from each metering pump to the spin pack. Insulating section 210 may include any suitable insulating materials, such as those previously described, to minimize or prevent heat transfer between neighboring pump block sections 200A and 200B. In addition, it is noted that any suitable number of insulating sections and pump block sections may be formed depending upon the number of differing polymer streams to be processes as well as the number of sets of conduits needed to process the streams.

Figure 6:
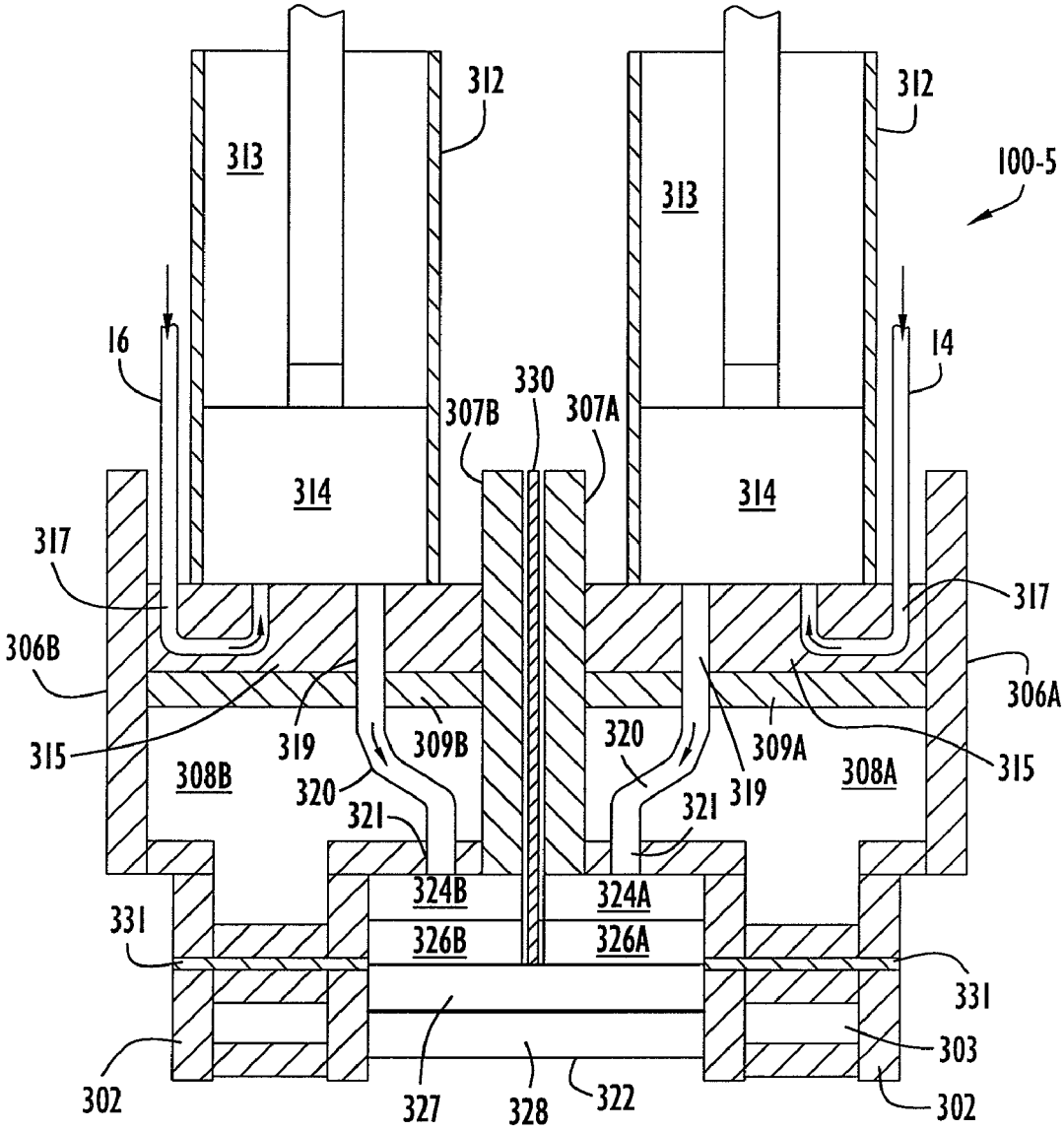
FIG. 6 is a side elevational view in section of a yet another embodiment of the spin beam assembly for the system of FIG. 1.

In a further embodiment, the pump block may further be partitioned into any selected number of compartments so as to include separate heating assemblies to independently control the temperature of the different sets of conduits within the pump block, where the heating assemblies extend into the spin pack. Referring to FIG. 6, temperature control system 100-5 includes a spin beam 302 that surrounds a portion of a spin pack 322. The spin beam includes hollow sections 303 that are filled with a thermal treatment fluid (e.g., Dowtherm) to maintain the spin beam at a selected temperature during operation of system 100-5. A partitioned pump block is disposed above and adjacent spin beam 302, with each partitioned section extending around portions of spin pack 322. An insulating material 331 is disposed between neighboring portions of the spin beam and the pump block sections to minimize or prevent heat transfer between the pump block sections and the spin beam.

The pump block includes two pump block sections 306A and 306B separated from each other by an insulating section 330 that is disposed between neighboring side wall plates 307A and 307B of sections 306A and 306B and extends vertically from the uppermost portion of the pump block sections into a portion of the spin pack as described below. As with the previous embodiments, system 100-5 may include any suitable number of partitioned pump block and/or other sections (e.g., three or more), depending upon the number of differing molten polymer streams to be processed. Each pump block section 306A, 306B includes a hollow section or chamber 308A, 308B that may be filled with any suitable insulating material (e.g., glass beads or other insulating material as described above) and/or thermal treatment fluid (e.g., Dowtherm) to independently maintain the chambers at selected temperatures. Each chamber 308 has a generally T-shaped configuration, with a lower end portion of the chamber surrounding an upper portion of spin pack 322 as described below.

A metering pump assembly 312 is provided for each pump block assembly 306A, 306B and includes a metering pump chamber 313 that houses a respective metering pump 314 and a base or wear plate 315 that supports the metering pump assembly and is disposed adjacent a top plate 309A, 309B of a respective pump block section 306A, 306B. Pipes 14 and 16 are connected to wear plates 315 and communicate with a respective metering pump 314 via U-shaped channels 317 disposed in the wear plates. Similarly, each metering pump 314 communicates with the spin pack 322 via corresponding channels 319 disposed in each wear plate 305 and a respective top plate 309A, 309B as well as conduits 320 extending within the hollow pump block chambers 308A, 308B between the top plates and corresponding channels 321 disposed in lower plate sections of the pump block chambers that are adjacent an upper portion of spin pack 322.

The spin pack 322 includes an upper portion that is surrounded by lower portions of the pump block chambers 308A, 308B and is further partitioned into sections by the vertically extending insulation section 330 which extends to the screen support plate 327 of spin pack 322. Each partitioned section of the spin pack upper portion corresponds with a respective pump block section 306A, 306B and includes a first spacer plate 324A, 324B stacked on top of a second plate 326A, 326B. The lower portion of spin pack 322 is surrounded by spin beam 302 and includes screen support plate 327 stacked on spinneret 328.

The temperature control system 100-5 of FIG. 6 provides for enhanced and independent temperature control of molten polymer streams flowing through the partitioned sections of the pump block at least as far as the screen support plate of the spin pack. As can be seen in the embodiment of FIG. 6, the temperatures of the upper partitioned sections of the spin pack are substantially controlled by their respective pump block sections, whereas the temperature of the lower section of the spin pack is primarily controlled by the spin beam.

It is to be understood that the embodiments described above and illustrated in the drawings represent only a few of the many ways of implementing a temperature control system to independently maintain molten polymer streams as selected temperatures during fiber extrusion.

The temperature control system may be utilized in any extrusion process including, without limitation, conjugate filament, conjugate staple, conjugate spunbond, and conjugate monofilament fiber extrusion processes. Any suitable heat management devices and/or techniques may be applied to separately maintain differing molten polymer streams within selected temperature ranges during system operation.

The temperature control system may include any suitable materials to form the conduits, pump block plates and/or other sections of the system, where the selected materials have selected heat transfer coefficients to ensure independent temperature control of differing molten polymer streams flowing through the system. The system may including any selected sets of conduits and/or channels for processing differing molten polymer streams, as well as any suitable number of metering pump assemblies and/or metering pumps. The pump block and/or other parts of the system may be partitioned into any selected number of sections to separate and effectively isolate different sets of conduits and/or channels from each other.

Any suitable temperature and/or pressure sensors (e.g., transducers, thermocouples, IR sensors, RTDs, etc.) may be provided at any selected locations within the system to provide feedback information corresponding to polymer flow temperatures so as to enhance the degree of independent temperature control of the streams. In addition, any form of heat control (e.g., heating elements, heating fluids, etc.) may be utilized to independently heat or cool selected sets of conduits and/or partitioned sections within the pump block. Any one or more different types of insulating materials or mediums may be utilized within the pump block to effectively isolate two or more sets of conduits that process differing molten polymer streams.

The spin beam may include any suitable configuration to maintain at least a portion of the spin pack within a selected temperature range. The pump block may include any suitable design to effectively minimize or prevent heat transfer between the spin beam and flow path sets containing molten polymer streams. The spin pack may include any suitable configuration to permit molten polymer to flow to the spinneret and form fibers of any selected geometric configuration. The spin pack may include any selected number of partitions to control and maintain molten polymer streams flowing through portions of the spin pack within selected temperature ranges.

Having described preferred embodiments of a temperature control system to independently maintain molten polymer streams as selected temperatures during fiber extrusion, it is believed that other modifications, variations and changes will be suggested to those skilled in the art in view of the teachings set forth herein. It is therefore to be understood that all such variations, modifications and changes are believed to fall within the scope of the present invention as defined by the appended claims.

What is claimed is:

1. A temperature control system for use in a fiber extrusion process comprising:

a plurality of metering pump assemblies to receive a plurality of molten polymer streams from at least one polymer supply source that is connectable to the system, each metering pump assembly including a pump chamber and a pump disposed within the pump chamber, wherein the pump of each metering pump assembly includes an inlet to receive a molten polymer stream from the at least one polymer supply source and a plurality of outlets to direct molten polymer from each metering pump; and a plurality of flow path sets disposed downstream from the metering pump assemblies, each flow path set being aligned with a respective metering pump and including a plurality of flow paths configured to receive molten polymer from the plurality of outlets of the respective metering pump and to deliver the molten polymer to a spinneret;

wherein each flow path set is spaced a selected distance from the other flow path sets so as to facilitate independent control of the temperature of a molten polymer flowing through each flow path set.

2. The system of claim 1, further comprising:

insulation material disposed between the flow path sets to selectively control heat transfer between molten polymers flowing through different flow path sets.

3. The system of claim 1, wherein at least one flow path set includes a thermal treatment unit to independently maintain molten polymer flowing through the at least one flow path set within a selected temperature range.

4. The system of claim 1, wherein at least one flow path set includes at least one sensor to measure at least one of the temperature and the pressure of molten polymer flowing through the flow path set.

5. The system of claim 1, wherein the flow paths comprise conduits disposed within a chamber.

6. The system of claim 5, wherein the chamber includes insulation material surrounding the conduits.

7. The system of claim 6, wherein the insulation material comprises glass beads.

8. The system of claim 5, wherein the chamber is partitioned into a plurality of sub-chambers, and the flow path sets are disposed in separate sub-chambers.

9. The system of claim 8, wherein each sub-chamber includes a heat treatment unit to independently maintain molten polymer flowing through each sub-chamber within a selected temperature range.

10. The system of claim 9, wherein the heat treatment unit for at least one sub-chamber comprises an inlet and an outlet to the sub-chamber, and the inlet is securable to a thermal supply source to facilitate delivery of a temperature-controlled thermal fluid into and out of the sub-chamber.

11. The system of claim 5, wherein the chamber is defined between a top plate disposed adjacent the metering pump assemblies, and a bottom plate opposing the top plate, and the top plate further includes grooved sections disposed at selected locations between metering pump assemblies.

12. The system of claim 1, wherein the flow paths comprise channels extending through portions of a solid pump block.

13. The system of claim 12, wherein the pump block is partitioned into a plurality of sub-sections via at least one insulation material, and the flow path sets are disposed in separate sub-chambers.

14. The system of claim 1, further comprising:

a spin pack including the spinneret, wherein the spin pack is aligned to receive molten polymer from the flow paths; and a spin beam disposed adjacent the spin pack, the spin beam including a thermal treatment unit to heat the spin beam and at least first portions of the spin pack to a selected temperature range.

15. The system of claim 14, further comprising an insulation material disposed between flow path sets to partition flow path sets into a plurality of sub-sections, wherein each sub-section includes at least one flow path set.

16. The system of claim 15, wherein the spin pack is partitioned into sub-sections via the insulation material.

17. A spunbond fiber extrusion system including the temperature control system of claim 14.

18. The system of claim 1, wherein at least one pump includes a heating element to independently maintain the pump within a selected temperature range.

19. The system of claim 1, wherein at least one pump chamber includes a supply conduit securable to a thermal fluid supply source to direct thermal fluid toward the pump within the pump chamber in order to independently maintain the pump within a selected temperature range.

20. A temperature control system for use in a fiber extrusion process comprising:

a spin pack including a spinneret to extrude fibers from molten polymer;

a spin beam oriented adjacent the spin pack and including a means to heat the spin beam and at least a portion of the spin pack to a selected temperature range;

a means for independently pumping a plurality of molten polymer streams from at least one polymer supply source to the spinneret, wherein the means for independently pumping comprises a plurality of pump chambers, each pump chamber including a pump disposed within the pump chamber, wherein each pump includes a plurality of outlets;

a plurality of flow path sets, each flow path set being connected with a respective pump and including a plurality of flow paths that connect with the plurality of outlets of the respective pump so as to deliver molten polymer from the respective pump to the spinneret; and a means for independently controlling the temperature of each molten polymer stream flowing within the means for independently pumping within a selected temperature range prior to delivery to the spinneret.

21. The temperature control system of claim 20, wherein the means for independently controlling the temperature of each molten polymer stream further controls heat transfer between molten polymer streams and the spin beam such that the temperature of each molten polymer stream within the system increases by no more than about 50% of the difference between the spin beam temperature and an inlet temperature of the molten polymer stream.

* * * * *